US005966144A

United States Patent [19]

Edwards

[11] Patent Number: 5,966,144

[45] Date of Patent: Oct. 12, 1999

[54] INK LEVEL SENSING FOR DISPOSABLE INK JET PRINT HEAD CARTRIDGES

[75] Inventor: Mark Joseph Edwards, Lexington, Ky.

[73] Assignee: Lexmark International, Inc., Lexington, Ky.

[21] Appl. No.: 08/856,160

[22] Filed: May 14, 1997

Related U.S. Application Data

[62] Division of application No. 07/980,847, Nov. 24, 1992, Pat. No. 5,691,750.

[51] Int. Cl.[6] ..... B41J 2/195

[52] U.S. Cl. ..... 347/7; 347/19

[58] Field of Search ..... 347/7, 19, 171, 347/237

[56] References Cited

U.S. PATENT DOCUMENTS

| | | | |
|---|---|---|---|
| 4,595,935 | 6/1986 | Brooks et al. | 347/171 |
| 5,049,898 | 9/1991 | Arthur et al. | 347/19 |
| 5,200,763 | 4/1993 | Tanuma et al. | 347/237 |
| 5,363,134 | 11/1994 | Barbehenn et al. | 347/49 |

FOREIGN PATENT DOCUMENTS

| | | | |
|---|---|---|---|
| 56-132815 | 10/1981 | Japan | H03K 13/00 |
| 6-132815 | 10/1981 | Japan | H03K 13/00 |
| 3-218847 | 9/1991 | Japan | B41J 2/175 |
| 4-144754 | 5/1992 | Japan | B41J 2/175 |

*Primary Examiner*—N. Le
*Assistant Examiner*—Judy Nguyen
*Attorney, Agent, or Firm*—John J. McArdle

[57] ABSTRACT

A printer having a disposable print head which contains a consumable ink supply includes the capability of determining the level of ink in the print head without directly measuring the ink supply. The print head includes a number of resistors which can be driven to an open circuit condition by the printer. The printer includes a counter and memory for tracking the usage of the print head and a driver for selectively driving the print head resistors to an open circuit condition based upon such usage. The printer is also capable of detecting the condition of the resistors on the print head and producing a resultant visual display.

6 Claims, 10 Drawing Sheets

RAM/ROM
17
16
43
BUFFER
42
BUFFER
41
BUFFER
32
COUNTER
18
DATA
CLOCK
STROBE
ENABLE IL
ENABLE 1
21
BUFFER
NVRAM
33
RD/WR
NV ENBL
35
RESET
DATA
CLOCK
14
MICRO-
PROCESSOR
45
46
44
12
19
COUNT 0
COUNT 1
COUNT 2
COUNT 3
COUNT 4
COUNT 5
COUNT 6
COUNT 7

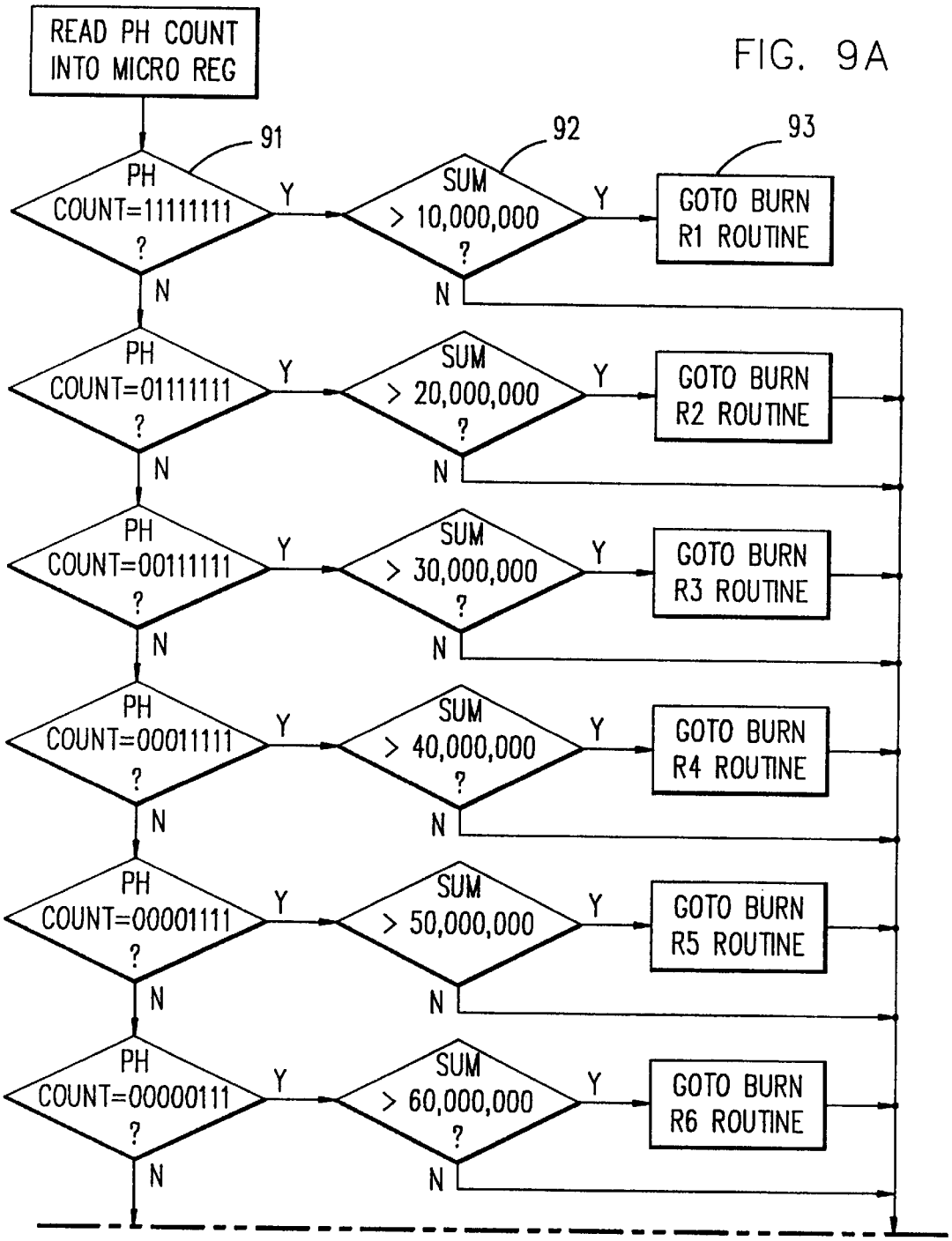
FIG. 9A
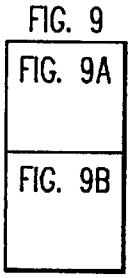

INK LEVEL SENSING FOR DISPOSABLE INK JET PRINT HEAD CARTRIDGES

This application is a division of application Ser. No. 07/980,847, filed Nov. 24, 1992, now U.S. Pat. No. 5,691, 750.

BACKGROUND OF THE INVENTION

This invention relates generally to printers and more particularly concerns printers with an ink supply, and monitoring of the level of ink in the ink supply. The invention is disclosed particularly in relation to an ink jet printer having a disposable ink jet print head containing an ink supply.

Exemplary of printers having a consumable ink supply are ink jet printers which apply droplets of ink onto a medium to effect printing. It would be useful to know the level of ink available for printing in such a printer in order to prevent, for example, exhaustion of the ink supply in the course of printing a page.

There have been ink jet printers which have provided "ink low" indications. Early ink jet printers had ink reservoirs; and they used floating contacts, limit switches or thermistors in a number of ink level sensing schemes. In today's "drop-on-demand" ink jet printers, at least one such printer uses a reservoir float for an "ink low" sensor, together with a lifetime print head and replaceable ink cartridges connected to that print head.

However, the majority of lower cost ink jet printers use disposable cartridges including both print head and ink. The cartridges are very inexpensive but do not lend themselves readily to previously used ink level sensing approaches, for reasons such as the small size and low price point of these cartridges.

Ink jet printers utilizing such disposable print head cartridges generally do not provide ink level sensing. If there is no ink level indication provided to the user of a printer, there will be inaccurate or complete lack of warning before a cartridge runs out of ink. In such a case the ink may run out in the course of printing a page, and then the print job must be redone.

It is the general aim of the invention to provide ink level monitoring in an ink jet printer which utilizes replaceable ink cartridges. The invention is particularly suited for use in ink jet printers which employ removable and disposable print head and ink cartridges.

In carrying out the invention, a printer is provided which includes a disposable print head with an ink supply, the print head being actuatable to dispense ink from the ink supply onto a record medium. The printer further includes means for maintaining a cumulative record of actuations of the print head and means which are responsive to this cumulative record for causing a physical change in the print head.

In one embodiment of the invention, to be described hereinafter, the record of actuation of the print head is maintained in a memory which periodically receives a count of ink drops to be fired by the print head. In this exemplary printer, the print head includes a number of resistors which are periodically driven to an open circuit condition as the droplet count in the memory increases. The printer is capable of detecting the condition of the resistors in the print head in order to provide an indication of the ink level in the print head.

Further advantages and uses of the invention will become apparent in the following detailed description, with regard to which:

DETAILED DESCRIPTION

Figure 1:
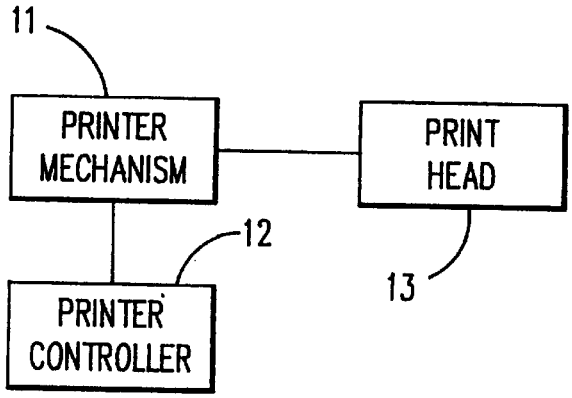
FIG. 1 is a generalized block diagram of a printer employing the present invention.

The invention will be described with reference to a "drop-on-demand" ink jet printer made up of a printer mechanism 11, a printer controller 12 and a replaceable print head 13, as shown diagrammatically in FIG. 1. As will be described in more detail subsequently, the printer controller 12 is a microprocessor-based controller, and the print head 13 is a cartridge which includes an ink supply and a number of heater resistors. The heater resistors are in nozzle chambers which communicate with the ink supply. Driving a heater resistor causes the formation of a bubble on the heater in the nozzle chamber, resulting in the jetting of an ink droplet through a nozzle in the nozzle chamber. In accordance with this embodiment of the invention, the print head 13 also includes ink level indicating resistors which are selectively driven to an open circuit condition as ink is used from the ink supply in the cartridge.

Figure 2:
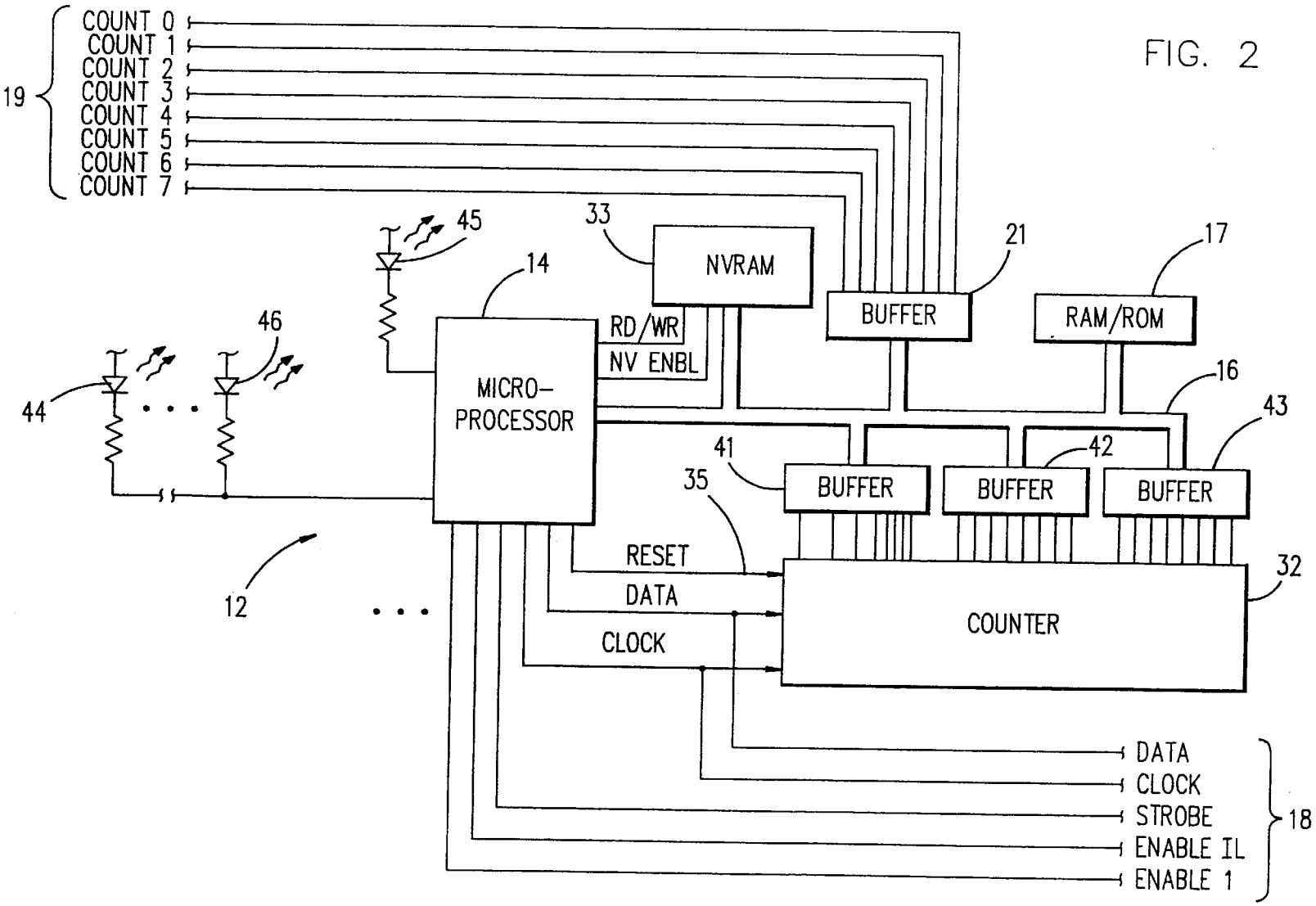
FIG. 2 is a more detailed block diagram of a portion of a controller for the printer of FIG. 1.

With regard to FIG. 2, the printer controller 12 includes a microprocessor 14 for controlling the paper feed and print head movement in the ink jet printer, firing of the heaters in the print head 13 (FIG. 1), and controlling the other functions of the printer. In one form of the invention, the microprocessor 14 (FIG. 2) was a Motorola 68008 microprocessor. The operation of the microprocessor 14 will be described herein only to the extent necessary to disclose the present invention.

The microprocessor 14 is coupled by a bus 16, which in the present case is an eight bit bus, to suitable random access and read-only-memory 17 to permit the microprocessor to control the print mechanism and print head. The print head DATA, CLOCK, STROBE and various ENABLE lines, collectively designated 18, connect the microprocessor 14 with print head drivers, which serve to energize the bubble jet print head resistors and also eight ink level indicating resistors. The eight print head ink level indicating resistors are also connected by print head COUNT lines, collectively designated 19, to the microprocessor 14 by way of the bus 16 and a tri-state buffer 21.

Figure 3:
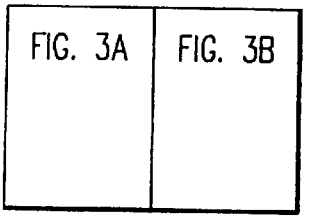
FIG. 3, made up of FIG. 3A and FIG. 3B, is a more detailed block diagram of portions of the printer controller and of the print head of FIG. 1.
Figure 3A:
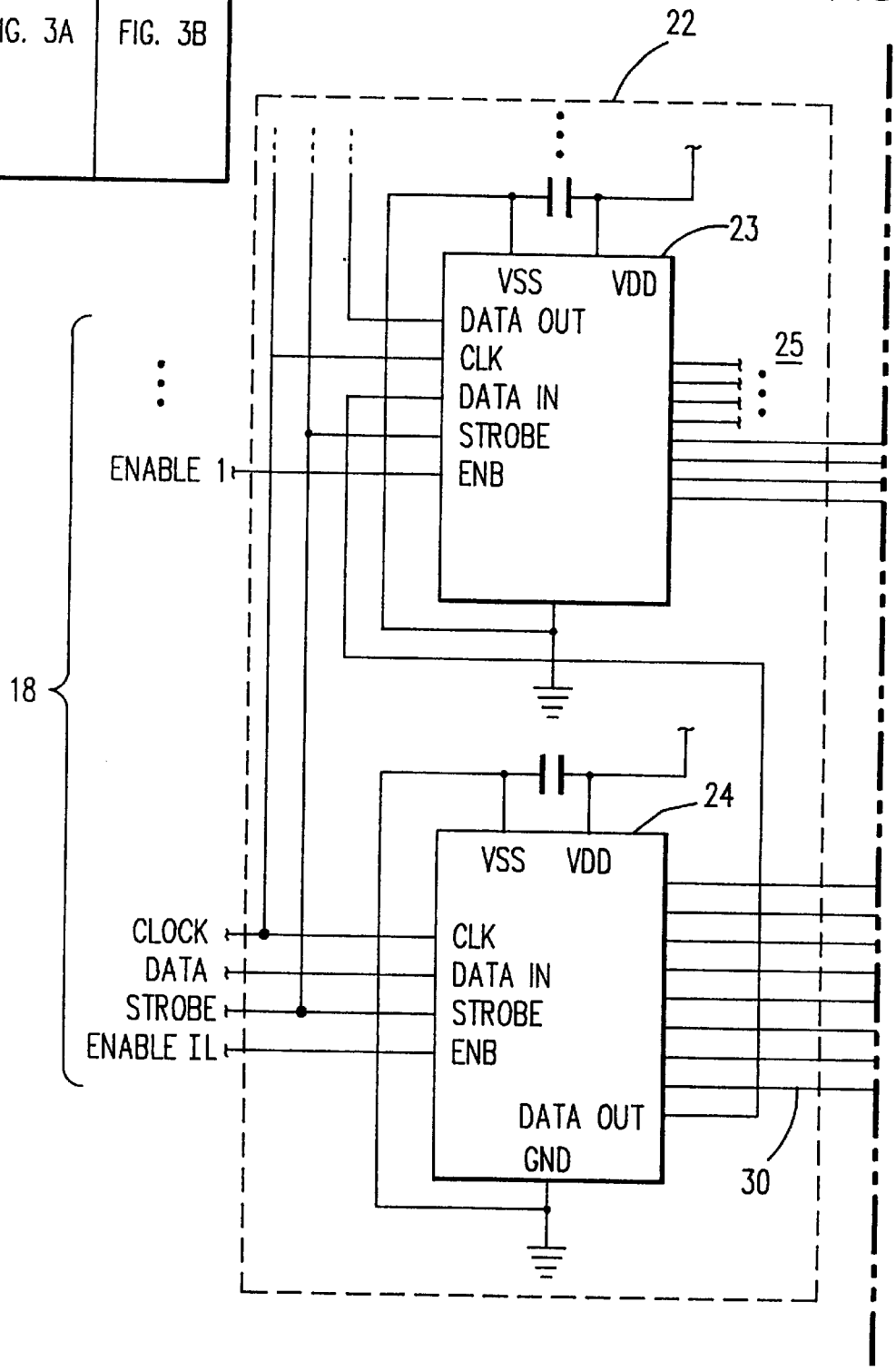
Figure 3B:
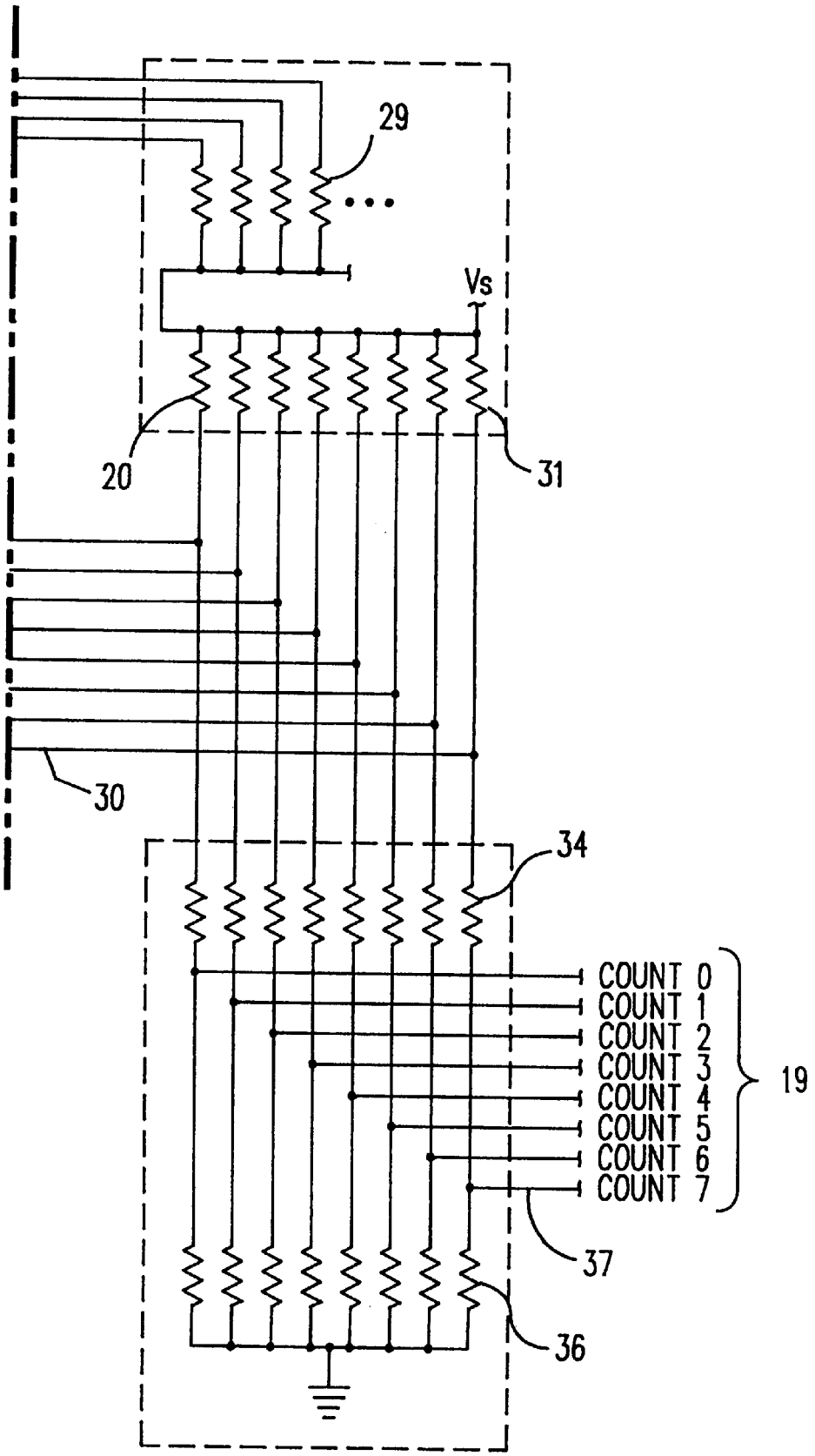
Figure 5:
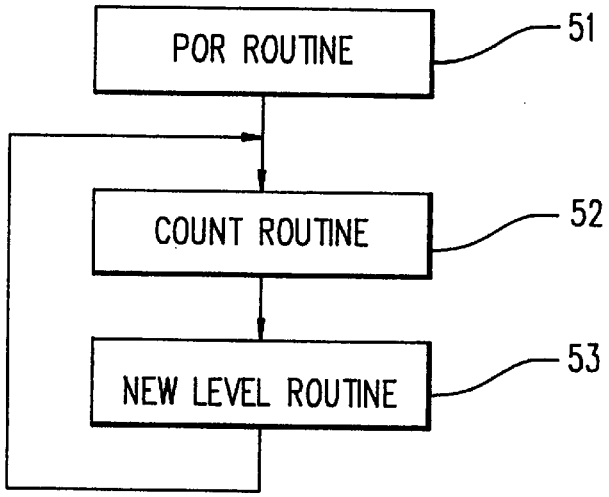
FIG. 5 is a flowchart of the ink level sensing and checking process carried out by the microprocessor of FIG. 2.
Figure 6:
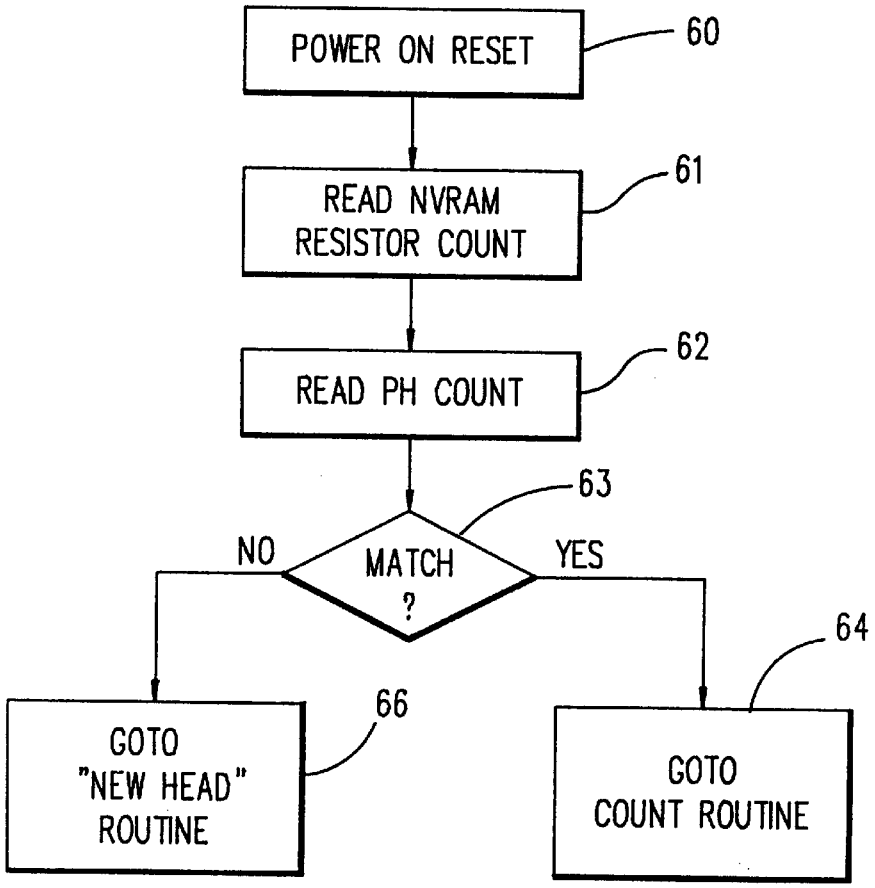
FIG. 6 is a flowchart of the power on reset routine of the flowchart of FIG. 5.

With reference now to FIG. 3, a print head driver circuit 22 in the printer mechanism is made up of a number of print head driver modules such as 23 which receive data serially and output bubble jet nozzle fire pulses on a group of parallel lines 25. A 1 in the serial data stream associated with one of the lines 25 causes a nozzle to fire on the head when firing is enabled. The illustrated driver modules are UCN 5821 driver modules.

Figure 4:
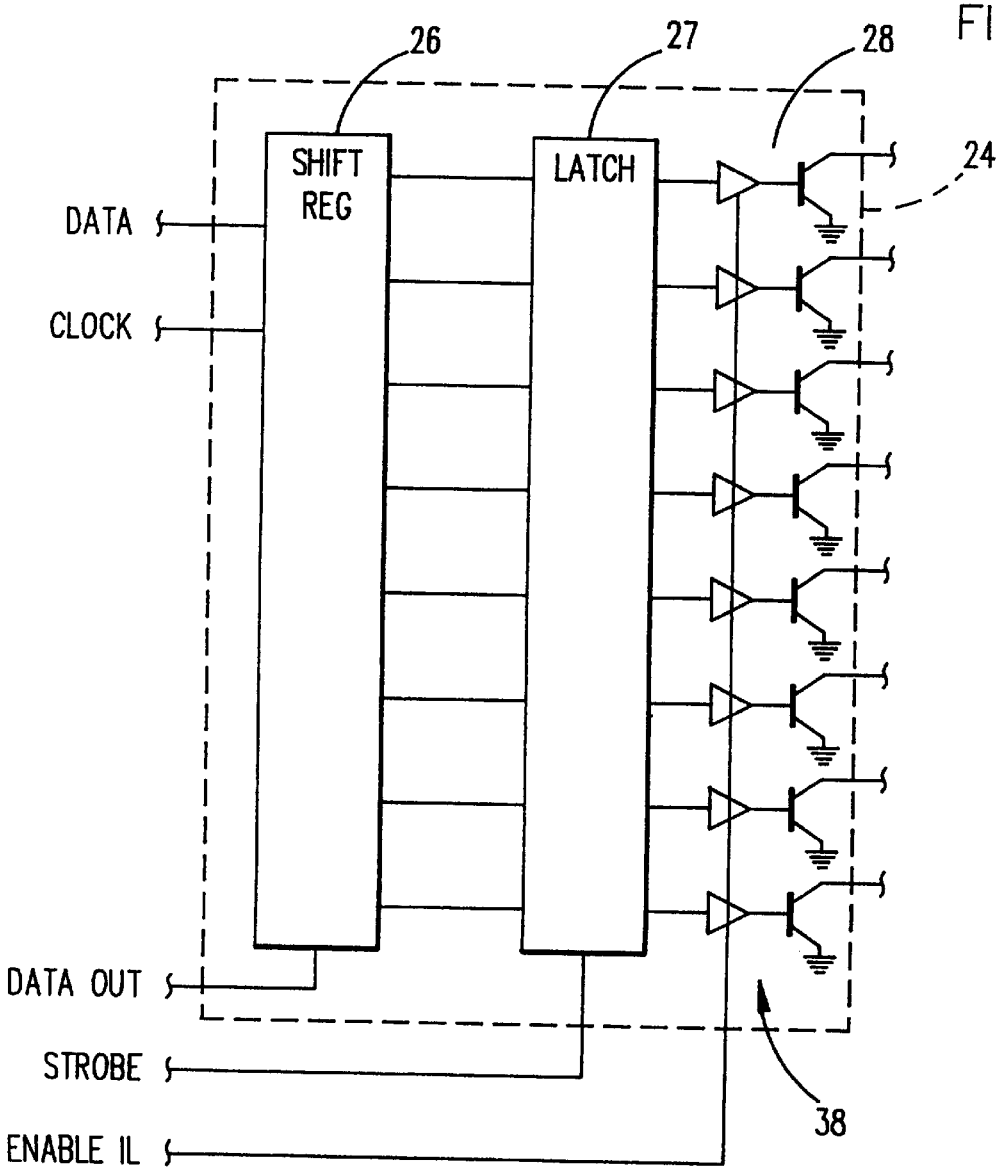
FIG. 4 is a diagrammatic illustration of a print module head driver of FIG. 3.

Heater resistors in ink jet nozzle chambers in the print head are driven by several driver modules such as 23, while an extra driver module 24 identical to module 23 is provided for burn-out resistors which indicate print head cartridge ink level. The burn-out resistors used to indicate print head ink level are segregated from the heater resistors, which are in nozzle chambers in the print head. As shown in FIG. 4, each of the driver modules such as module 24 includes an eight bit serial-in, parallel-out shift register 26, an eight bit latch 27, and eight Darlington driver transistors such as 28. Serial data on the DATA line is shifted into the shift register 26 with each activation of the CLOCK line by the microprocessor 14 (FIG. 2). The several driver modules such as 23 used to drive the ink jet heater resistors, and the driver module 24, used to burn out the ink level resistors, are daisy chained (DATA OUT of one module connected to DATA IN of the next) so that all the ink drop firing data for all of the print head nozzles, or all of the resistor burn out data, can be serially shifted into the shift registers of the driver modules. When all of the modules' shift registers have been loaded with data, the data in the modules is transferred from the shift registers 26 to the latches 27 when the STROBE line is activated by the microprocessor. Each driver module's output driver transistors, such as the driver transistor 28, are enabled to fire when the module's ENABLE line goes active if the associated latch data bit is a 1, or at a logic "high". In normal printing operation, the drivers such as 23 are sent print data while the ink level resistor driver 24 is sent zeroes, all in the same serial data transfer. For ink level resistor operation, the heater drivers such as 23 are sent zeroes, and the driver 24 is sent data all in one serial transfer.

Both the ink jet heater resistors such as 29 (FIG. 3) and the ink level-indicating burn-out resistors such as 31 are on the print head and are connected on one side to the DC supply voltage VS. The other side of each resistor is connected to the collector of a drive transistor in a driver module such as 23 or 24. The burn out resistors such as 31 are also connected to resistor dividers, such as the resistors 34 and 36.

When not enabled by a pulse on the ENABLE line and a logic "high," or "1" in the associated latch position, the drive transistor appears as a high impedance; and no current flows through a resistor such as 29, or just a small amount of current flows through a resistor such as 31 due to the resistor divider. When a drive transistor is enabled, it appears as a very low impedance and a large drive current flows through the associated resistor into the transistor. In the case of heater resistors such as 29, a bubble is formed on the heater and ink is expelled from a nozzle when the heater resistor is energized. Thus, the heat resistors such as 29 function as actuators for causing dispensing of ink from an ink supply when energized through energization of the drive transistor such as 28 by a pulse.

In the case of a burn-out resistor such as 31, the resistor heats until it burns to an open circuit condition. This open circuit condition creates a substantially irreversible significant change in resistance of the burned-out resistor.

In order to track ink usage, the microprocessor 14 (FIG. 2) counts print head dots to be fired by monitoring the 1's on the DATA line as the 1's and 0's are clocked to the print head driver circuit 22 (FIG. 3). The microprocessor 14 (FIG. 2) updates the cumulative count from a counter 32 into non-volatile RAM (NVRAM) 33 at the end of every form boundary, typically at the end of each page printed by the printer.

There are eight extra resistors such as 31 (FIG. 3) on the print head which act like fuses and, as indicated earlier, they are burned to an open circuit condition when driven. The eight driver transistors in the driver module 24 drive the resistors such as 31 to an open circuit condition, one at a time, after certain amounts of print head usage.

In order to provide an indication of print head ink level, the number of open resistors is sensed, and the count of open circuited resistors is coupled back to the microprocessor 14 (FIG. 2). A resistor divider for each burn-out resistor permits sensing an open-circuit condition. For example, the burn-out resistor 31 (FIG. 3) is in a resistor divider made up of the sensor resistors 34 and 36. If the drive transistor on the drive line 30 of the driver module 24 is not enabled, the voltage at the divider output 37 between the resistors 34 and 36 is about 3.6 volts, or a logic "high" to indicate a state of conductivity. In this example, VS is about 19 volts, the resistor 31 is relatively small, such as 30 ohms, while the resistor 34 is about 4.22K ohms and the resistor 36 is about 1.00K ohms. After activation of the drive transistor on the line 30, there is a large current flow from VS through the resistor 31 into the transistor 38 (FIG. 4), which burns the resistor open. Thereafter, the voltage at the divider output 37 (FIG. 3) becomes extremely small, such as a few tenths of a volt, appearing as a logic "low" to indicate a state of non-conductivity. When the driver transistor turns off, after the resistor 31 is open circuited, the divider output 37 is effectively held to ground or at a logic low to remain in the state of non-conductivity. The state of each of the burn-out resistors such as 31, as to whether it is conductive or non-conductive, is returned to the microprocessor 14 (FIG. 2) through tri-state buffer 21 and the data bus 16.

The counter 32, which accumulates a count of the dots to be printed, is selected to be large enough to hold the count of activated nozzle heaters for the maximum amount of printing which can occur before the count in the counter is added to the count in the NVRAM 33 and the counter 32 is reset. In the present instance, a worst case form-boundary to form-boundary count, or the maximum dot count which the counter must be able to store before off-loading the count to the NVRAM, is a little over sixteen million dots, equivalent to an all-black graphics page. This size count requires a 24 bit counter.

The counter data is moved onto the bus 16 through tri-state buffers 41–43 and written to NVRAM 33 (FIG. 2). Light emitting diodes such as 44 and 46 are provided on the printer operator panel for ink level indications, which are selected by the microprocessor 14 based upon the information from the sense lines 19. An "ink low" LED 45 is also provided, and this LED is energized when all of the ink level indicating resistors such as 31 (FIG. 3) have been open-circuited.

Turning now to FIGS. 5–10, the microprocessor 14 executes a number of routines to effect the foregoing ink level sensing and indicating functions. These routines are illustrated in flow chart form. In the process overview shown in FIG. 5, the microprocessor first executes a Power-On Reset routine 51. In this routine (FIG. 6) the processor determines if the print head has been changed since the last time the printer was powered on. The processor reads the NVRAM resistor count (61) and reads the print head resistor count (62). The processor then compares the resistor count on the print head with the resistor count saved in NVRAM from the last power down to determine if there is a match (63). The resistor count on the print head is determined by reading the "high" and "low" conditions of the sense points on the lines 19 (FIG. 3) through the tri-state buffer 21 (FIG. 2).

Figure 7A:
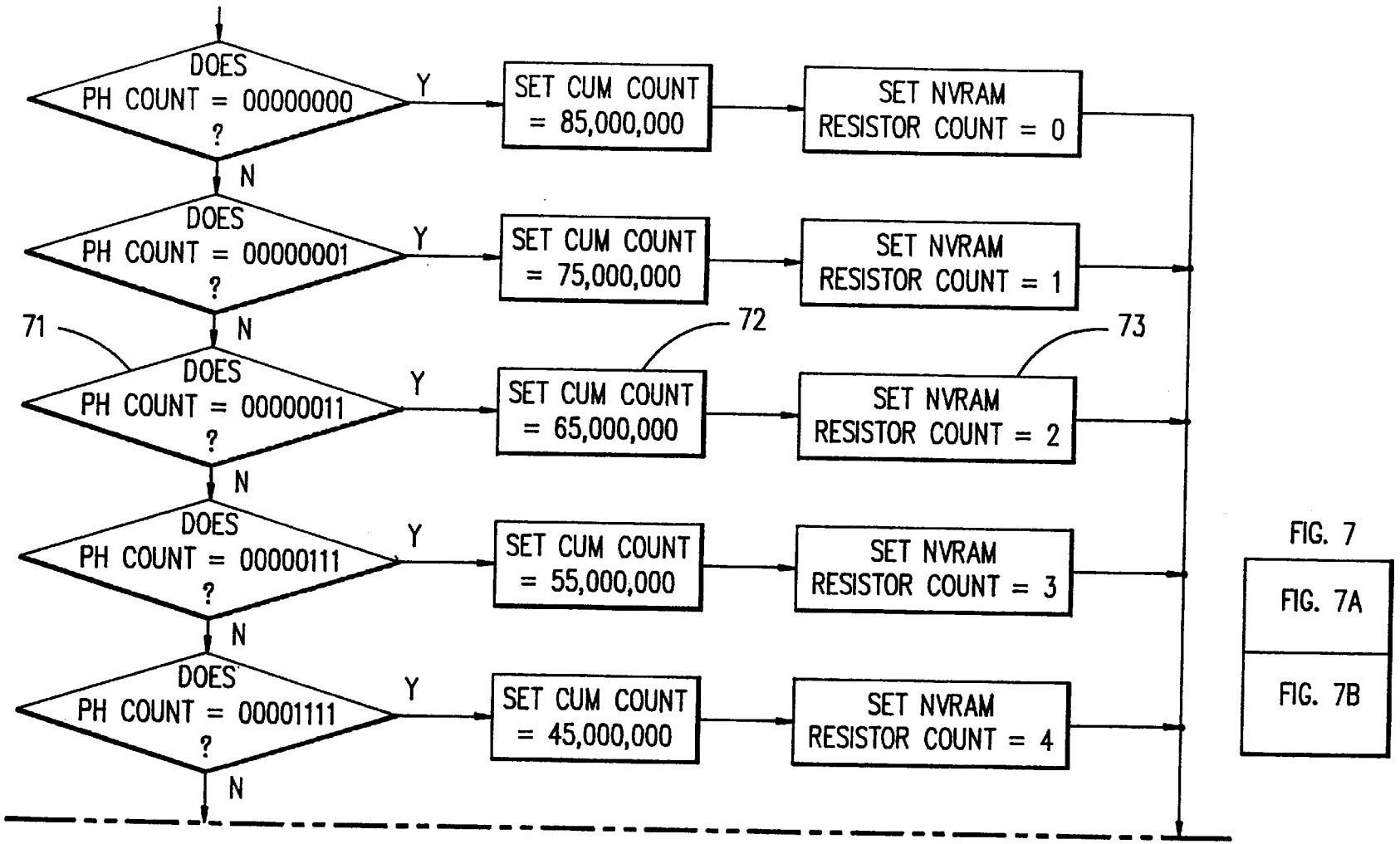
FIG. 7 made up of FIG. 7A and FIG. 7B, is a flowchart of the "new head" routine of FIG. 6.
Figure 7B:
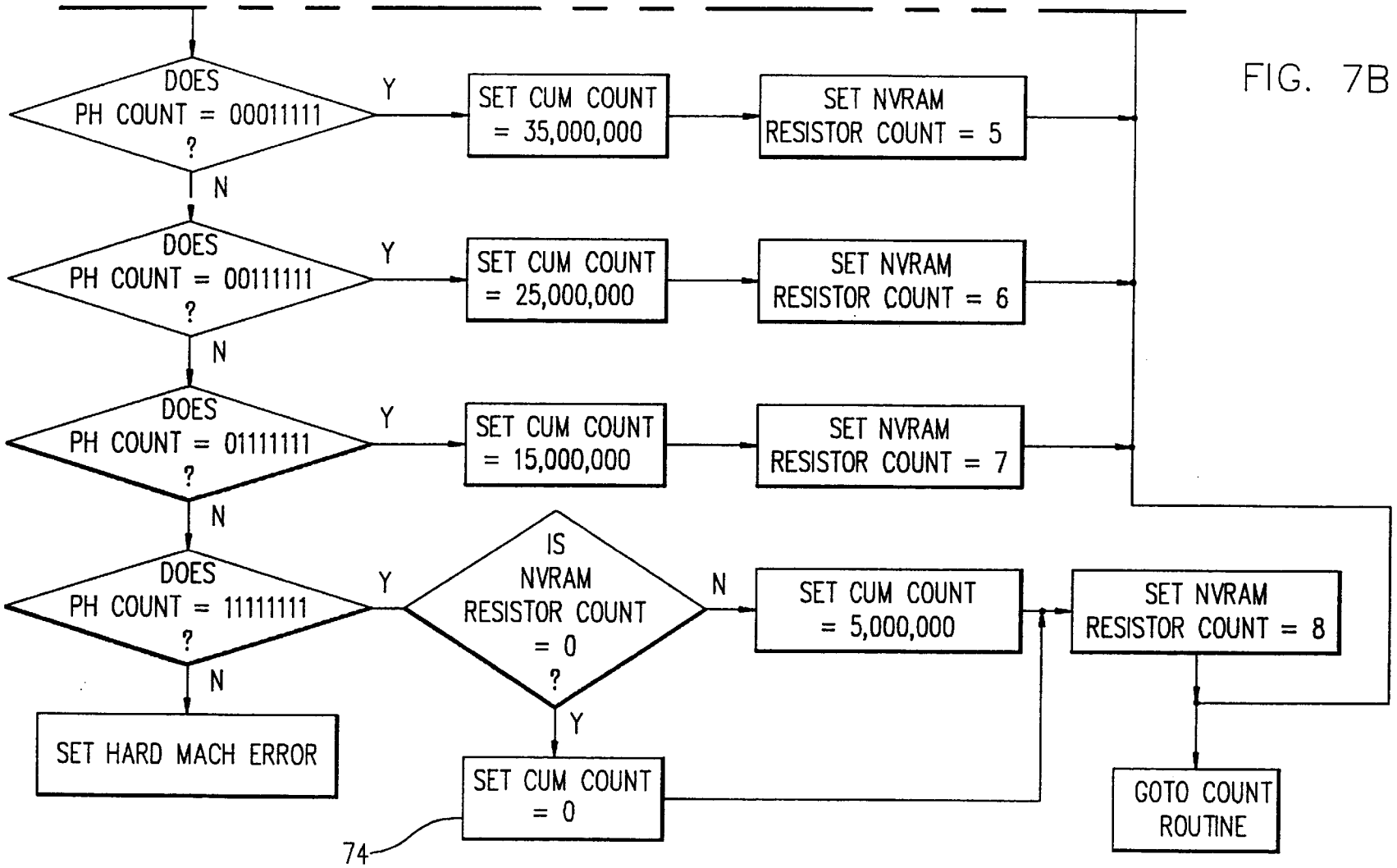

If the stored count and the sensed count match, it is assumed that the print head has not been replaced, and the processor proceeds (64) (FIG. 6) to the Count routine. If the resistor counts do not match, it is assumed that the print head has been replaced with a new print head, and the processor proceeds (66) to the "new head" routine (FIG. 7).

The "new head" routine (FIG. 7) resets the cumulative count in the NVRAM based on the print head resistor count. This print head resistor count is 0–7 depending upon how many of the eight sense resistors have been open-circuited on the print head. In the exemplary form of print head, cartridge life is about 90 million ink drops, or dots. If a new print head has, for example, two count resistors intact (71), the NVRAM cumulative count will be set (72) to 65 million. This is based upon 6 open count resistors representing usage from 60 million to 70 million dots. Similarly, one open count resistor-represents usage from 10 million to 20 million dots, etc. The processor also sets the resistor count in the NVRAM to the print head resistor count. In the earlier example, the NVRAM resistor count is set to "2" (73).

Since the point of actual usage in the possible range is not known, the mid-point for the range of usage for a particular resistor count is chosen. An exception is made in the case of a spent (eight open resistor) head being replaced by a new head. In this case, it is assumed that the new head with eight intact ink-low resistors is indeed unused and the NVRAM cumulative count is reset to zero (74).

Figure 8:
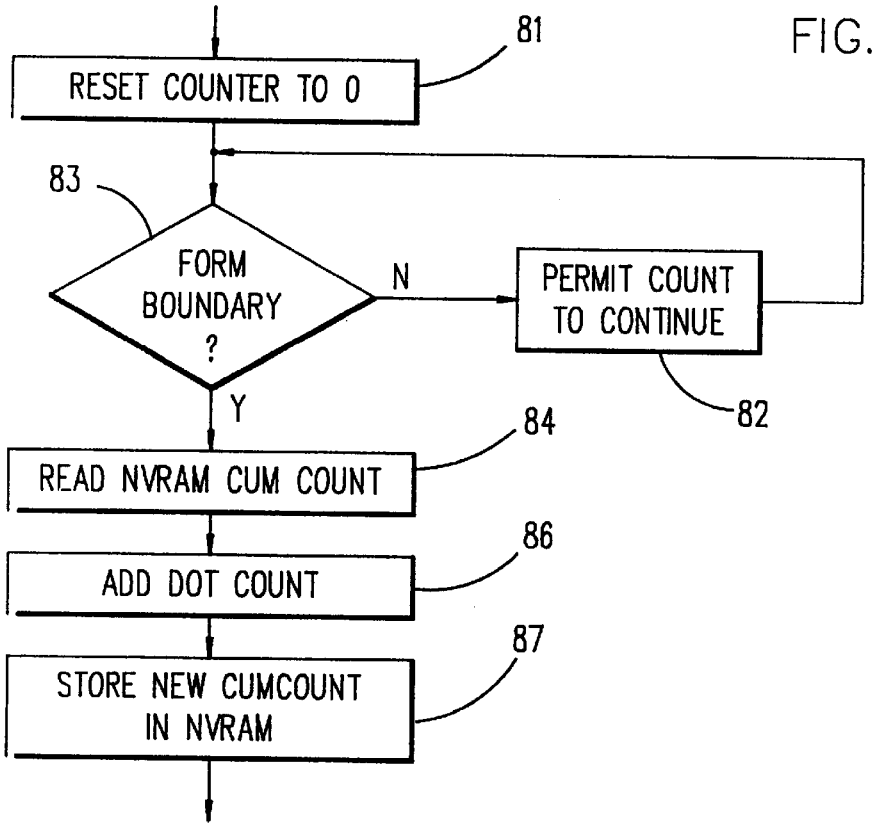
FIG. 8 is a flowchart of the count routine shown in FIG. 5.

With the NVRAM information properly updated by the "new head" routine (FIG. 7), or directly after the power on reset routine 51 if it does not appear that the print head has been changed, the microprocessor executes the Count routine 52, shown in more detail in FIG. 8. The Count routine is continuously executed during operation of the printer to track the ink usage of the print head.

In the Count routine, the counter 32 (FIG. 2) is reset to zero (81) by the microprocessor 14 via the RESET line 35. Subsequently, logic 1's in the print data stream, which will result in the firing of ink drops, are added in a cumulative count in the counter. The counter is allowed to cumulate (82) (FIG. 8) the drop counts until a form boundary is encountered (83), typically a form feed at the end of a page. At the form boundary, the microprocessor reads (84) the NVRAM cumulative count and adds (86) the count from the counter 32 (FIG. 2) to the NVRAM cumulative count to get a new sum, which is stored (87) (FIG. 8) in the NVRAM 33 (FIG. 2).

Returning to FIG. 5, to determine if the new sum exceeds a level boundary (meaning another ⅙th of the cartridge's ink has been used up), the "New Level" routine (FIG. 9) is entered (53). If the cumulative count in the NVRAM is not beyond a level boundary, the count routine is reentered (90), resetting the counter to zero and permitting an accumulation of dot count for the next page.

Figure 9B:
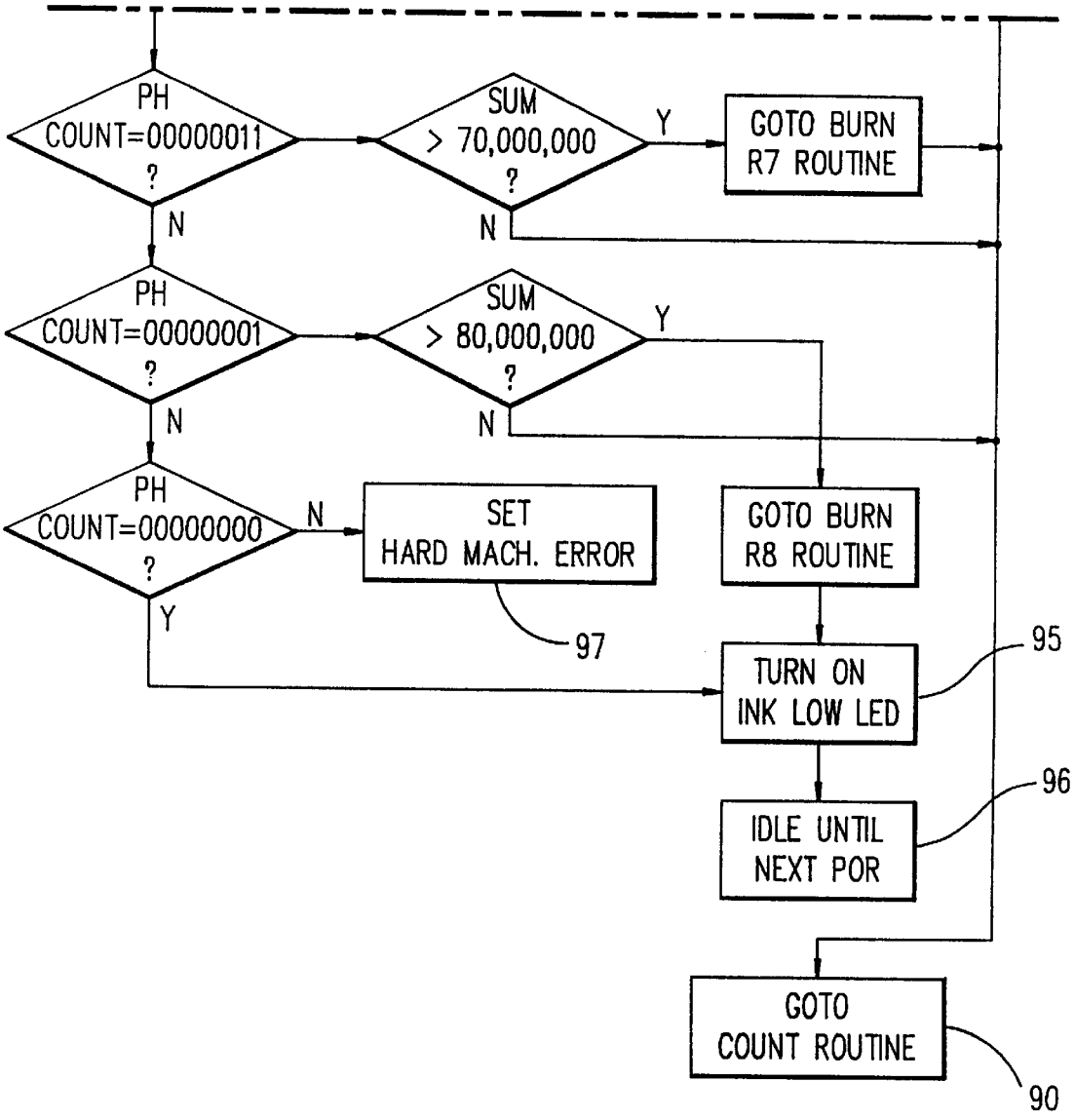
FIG. 9, made up of FIG. 9A and FIG. 9B, is a flowchart of the new level routine of FIG. 5.

The new level routine of FIG. 9 shows how the microprocessor determines if the count is beyond a level boundary. In the new level routine the print head resistor count is loaded by the processor into a register where it is compared to the new cumulative count in the NVRAM 33 (FIG. 2). The microprocessor then determines if a resistor should be burned open on the print head, to indicate a reduced ink level, and which resistor that should be. For example, if the print head count is all 1's (91) (FIG. 9), meaning that none of the print head resistors have yet been open circuited, but the new cumulative count in NVRAM is greater than 10 million dots (92), it is time to burn open (93) the first resistor (the resistor 20 in FIG. 3), to record that ⅙th of the cartridge's ink has been expended. If the resistor count is all 1's, but the cumulative dot count from NVRAM is not yet greater than 10 million (92) (FIG. 9), the level boundary has not been reached and the microprocessor returns (90) to the Count routine 52.

Figure 10:
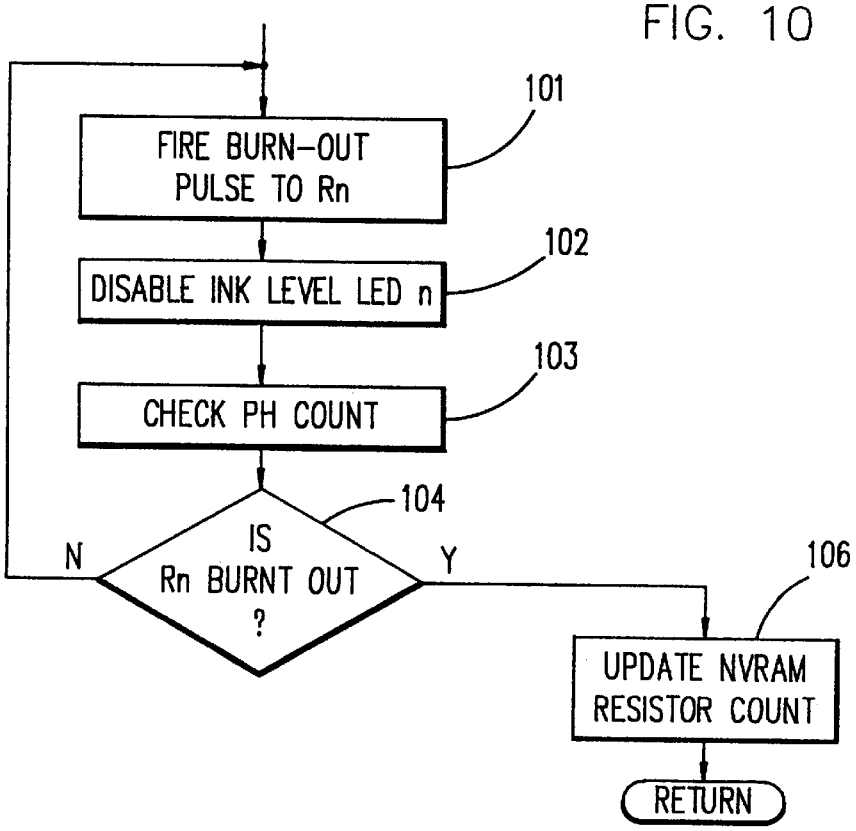
FIG. 10 is a flowchart of a typical burn resistor routine of FIG. 9.

For a given resistor count on the print head, if a dot count from the NVRAM 33 (FIG. 2) indicates that a new level (of a multiple of 10 million dots) has been reached, then the appropriate next resistor on the print head is open circuited, by execution of a Burn Resistor routine to open the appropriate resistor. An exemplary Burn Resistor routine is shown in FIG. 10, to be described subsequently.

In essence, the Burn Resistor routine (FIG. 10) results in the loading of the appropriate serial datastream to the print head to fire a burn-out pulse to the desired ink level resistor. For example, to burn open the resistor 20 (FIG. 3) a byte of data 10000000 is clocked into the shift register of the driver module 24 (FIG. 4); strobed to the latch 27 in the driver module 24; and, when the ENABLE IL line is driven, the Darlington transistor 28 is driven coupling the DC supply voltage VS through the resistor 20, open circuiting the resistor 20 (101) (FIG. 10). When the data is clocked into the driver module 24 (FIG. 3), zeroes are clocked into all the other driver modules such as 23.

In the present printer, ink level LED's are provided, corresponding to the resistors which can be open circuited. Therefore, in the Burn Resistor routine of FIG. 10, after a burn-out pulse is fired to open a particular resistor, a corresponding ink level LED is turned off (102). The print head count is then reread (103) to determine if the ink low resistor has been burned open (104). If not, the Burn Resistor routine is re-executed. If so, the NVRAM resistor count is updated (106) and the microprocessor returns to the New Level routine (FIG. 9).

When returning from executing the Burn R8 Routine, which opens the resistor 31 (FIG. 3), indicating that all of the count resistors on the print head are open and the ink supply is about to be exhausted, the processor turns on (95) (FIG. 9) the ink low LED 45 (FIG. 9) and idles (96) until the next power-on reset. If one of the other resistors has been open circuited in a Burn Resistor routine of FIG. 10, the processor returns to the Count routine of FIG. 9. If an illegal resistor count is read, such as 10001111, processing stops; and a hard machine error is set (97).

Variations of the present ink level monitoring approach are, of course, possible. For example, more or fewer burn-out resistors could be used to provide more or less "resolution" in tracking ink usage. The drivers, sensors, counter and other circuitry can also be implemented in different ways. The frequency of updating the NVRAM count can be increased to be more often than at form boundaries. This would increase the resolution of the system in tracking the cartridge ink level. Also, rather than idling after an "ink low" indication, printing may be allowed to continue.

It should also be apparent that ink level information can be used not only for indicating ink level to the user to facilitate changing ink cartridges in a timely manner, but also for inhibiting the use of refilled ink cartridges in which all the resistors have been burned open.

What is claimed is:

1. A disposable print head cartridge for an ink jet printer providing a first voltage and second voltage different from said first voltage, the cartridge containing, a print head containing an ink droplet activation device, an ink supply in flow communication with said ink droplet activation device and an ink supply indication circuit comprising:

a plurality of burn-out resistors, each of said burn-out resistors having a closed circuit condition and a permanent open circuit condition upon activation, having first ends for being connected by means of a first conductor to the first voltage, and having second ends;

a plurality of resistor dividers, each of said resistor dividers being connected in series with one of said burn-out resistors, each of said resistor dividers having first and second resistors having predetermined resistances, each of said first resistors having a first end connected to one of the second ends of said burn-out resistors and having a second end, and each of said second resistors having a first end connected to the second end of one of said first resistors and a second end connected by means of a second conductor to the second voltage;

a plurality of third conductors, each of said third conductors connected to a unique one of the second ends of said burn-out resistors and the first ends of said first resistors for supplying a third voltage to the second ends of said burn-out resistors, the difference between the first and third voltages being sufficient to burn the burn-out resistor and create an open circuit condition at the position of the burned burn-out resistor to update the data stored by said burn-out resistors in order to indicate the approximate amount of ink remaining in the ink supply;

a plurality of fourth conductors, each of said fourth conductors being connected to a unique one of said resistor dividers between the first and second resistors of the resistor dividers for communication with said printer to indicate said open or closed circuit condition of said bum-out resistors, said fourth conductors supplying a fourth voltage having a magnitude proportional to the ratio of the predetermined resistance of said second resistor divided by the sum of the predetermined resistances of said first and second resistors and the resistance of said burn-out resistor to indicate a closed circuit condition.

2. The print head cartridge of claim 1 wherein said open circuit condition is inversely proportional to said ink supply level.

3. The print head cartridge of claim 1 comprising at least eight burn-out resistors.

4. The print head cartridge of claim 1 comprising at least eight resistor dividers.

5. The print head cartridge of claim 1 comprising at least eight first resistors and at least eight second resistors.

6. The print head cartridge of claim 1 wherein the burn-out resistors and resistor dividers are disposed on the print head.

* * * * *